US007634845B1

(12) United States Patent
Sim

(10) Patent No.: US 7,634,845 B1
(45) Date of Patent: Dec. 22, 2009

(54) AUTOMOTIVE SUSPENSION TOOL

(76) Inventor: Henry Sim, 45-685 Kamehameha Hwy., Kaneohe, HI (US) 96744

( * ) Notice: Subject to any disclaimer, the term of this patent is extended or adjusted under 35 U.S.C. 154(b) by 202 days.

(21) Appl. No.: 11/451,175

(22) Filed: Jun. 12, 2006

(51) Int. Cl.
*B66F 3/00* (2006.01)

(52) U.S. Cl. ..... 29/267; 29/270; 29/278; 254/25

(58) Field of Classification Search ..... 29/267, 29/243.56, 255, 278, 272, 283, 270; 254/15, 254/17, 25, 131
See application file for complete search history.

(56) References Cited

U.S. PATENT DOCUMENTS 1,372,389 A * 3/1921 Bailey et al. ..... 29/213.1
2,624,544 A * 1/1953 Graham ..... 254/15
2,681,791 A * 6/1954 Hahn ..... 254/131
2,896,910 A 7/1959 Cooper
4,039,140 A 8/1977 Pulliam
4,826,136 A 5/1989 Thomas
4,999,898 A 3/1991 Schmeling
5,020,202 A 6/1991 Turrell
5,271,115 A * 12/1993 Senters ..... 7/100
5,626,063 A 5/1997 Kosbab
5,832,581 A * 11/1998 Barthuli ..... 29/267
5,909,910 A 6/1999 Shaffer
D424,901 S 5/2000 Landry
6,113,074 A * 9/2000 Foley ..... 254/25
6,634,620 B2 * 10/2003 Sim ..... 254/131

* cited by examiner

*Primary Examiner*—Lee D Wilson
(74) *Attorney, Agent, or Firm*—Michael I. Kroll

(57) ABSTRACT

An automotive tool serving as a pinch bar and lever for gripping an automotive suspension workpiece between first and second tool elements and an extended handle for increasing force to free the workpiece from its fastened position. Alternately, the first and second tool elements can be positioned against opposing workpieces to free one from the other again using the extended handle to amplify the applied force causing separation. The tool is designed for the automotive repair industry in the removal and installation of suspension members, such as CV joints, ball joints, struts, etc that require the dismantling of parts that have bonded due to dirt, wear and electrolytic reactions, such as oxidation, resulting in time intensive and hazardous tasks depending on the inventiveness of the mechanic in performing the separation task.

23 Claims, 11 Drawing Sheets

AUTOMOTIVE SUSPENSION TOOL

BACKGROUND OF THE INVENTION

1. Field of the Invention

The present invention relates generally to manually operated hand tools and, more specifically, to a tool serving as a pinch bar and lever having means for gripping an automotive suspension fastened workpiece between first and second tool elements and an extended handle for magnifying a force placed thereon to free the workpiece from its fastened position. Alternately, the first and second tool elements can be positioned against opposing workpieces to free one from the other again using the extended handle to amplify the applied force causing separation.

More specifically, the tool is designed for the automotive repair industry in the removal and installation of suspension members, such as CV joints, ball joints, struts, etc that require the dismantling of parts that have bonded due to dirt, wear and electrolytic reactions, such as oxidation, resulting in time intensive and hazardous tasks depending on the inventiveness of the mechanic in performing the separation task.

Furthermore, some of these parts are compressed by tensioning members, which is not where you want your fingers to be. According to OSHA and the U.S. Department of Labor estimates, there are approximately 3,000,000 workers in the automotive industry and as more females enter the automotive workplace the need increases for more ergonomic tools that are less dependant on an individual's muscle mass and more considerate of the aforementioned safety concerns and can result in lower labor costs to the consumer through employment of the present invention within the automotive industry.

It should be noted that careful consideration was given and is considered an integral part of the inventive process as to the angular position of the handle when the tool is placed in the operative position since many of the suspension members extend downwardly. Preferably, once engaging the workpiece the handle is cantilevered in a positive horizontal plane.

Additional consideration was given to one of the workpiece engaging members incorporating hanger means so that once placed in the operative position, it would remain there allowing for hands free operation for the user by straddling the handle and applying the necessary pressure by leaning on the handle as needed. In other words, the tool provides means whereby the user doesn't have to use their hands to apply force. Using one's legs either by straddling the handle or simply apply pressure to the handle with a knee provides for hands free operation.

The other engaging member was also found to be more functional having a hyperbolic tip that can more easily engage tubular members from varying degrees.

It is not considered essentially to the invention that the tip form a curved plane or that the hanger have a somewhat U-shape but the tool is functionally more ergonomic incorporating these improvements, as opposed to a flat or rounded tip or the hanger having more of an L-shape. The tool would certainly function in a similar manner but not as efficiently. There is also a brace extending between the curvature at the base of the handle and the shaft extending to the tool tip with the hanger fastened thereto and extending therefrom. Again it was found through trial and error that this arrangement provided a more durable tool as opposed to fastening the hanger to the main tool shaft. The tool would still function within the scope of the present invention but it is felt would result in an inferior quality tool. Therefore such an arrangement is within the scope of the present invention, but preferably manufactured having a brace with the hanger extending therefrom, which will provide a more durable and quality tool.

2. Description of the Prior Art

There are other tools designed for manual use. Typical of these is U.S. Pat. No. 2,681,791 issued to Hahn on Jun. 22, 1954.

Another patent was issued to Cooper on Jul. 28, 1959 as U.S. Pat. No. 2,896,910. Yet another U.S. Pat. No. 4,039,140 was issued to Pulliam on Aug. 2, 1977 and still yet another was issued on May 2, 1989 to Thomas as U.S. Pat. No. 4,826,136.

Another patent was issued to Schmeling on Mar. 19, 1991 as U.S. Pat. No. 4,999,898. Yet another U.S. Pat. No. 5,020,202 was issued to Turrell on Jun. 4, 1991 and still yet another was issued on Dec. 21, 1993 to Senters as U.S. Pat. No. 5,271,115.

Another patent was issued to Kosbab on May 6, 1997 as U.S. Pat. No. 5,626,063. Yet another U.S. Pat. No. D424,901 was issued to Landry on Dec. 21, 1993. Another U.S. Pat. No. 5,909,910 was issued to Schaffer on Jun. 8, 1999 and still yet another was issued on Oct. 21, 2003 to Sim as U.S. Pat. No. 6,634,620.

U.S. Pat. No. 2,681,791

Inventor: Clair F. Hahn

Issued: Jun. 22, 1954

A brake adjusting tool comprising a substantially straight bar having one end portion thereof flattened on two opposite sides, a lug disposed outwardly from the bar on one of said two sides at a point spaced from said one end thereof, a pivot pin carried by said lug and extending from one side of the lug at right angles thereto, and a hook lever pivoted upon said pivot pin and movable around said pivot pin only in a plane parallel with the bar, said hook lever being of a length slightly greater than the distance from the pivot pin to said one end of the bar and having an angular hooked end extending to a point on the opposite side of said bar from the pivot pin and terminating in a backwardly disposed end, whereby the hook lever may be swung over said one end of the bar so that it may be disposed upon either of said first mentioned two sides of the bar with the hooked end thereof located closer to the axis of the bar in one position than in the other position.

U.S. Pat. No. 2,896,910

Inventor: Guy R. Cooper

Issued: Jul. 28, 1959

The present invention relates to new and useful improvements in tools for use by carpenters either in the erection or demolition of buildings. A hand tool embodying a wrecking bar and constructed at one end with a U-shaped hook which projects laterally at one side of the bar and which may be used for various purposes in engaging lumber during the construction or wrecking of a building.

U.S. Pat. No. 4,039,140

Inventor: Barron Pulliam

Issued: Aug. 2, 1977

A tool for removing nails in the form of a bar curved to form a fulcrum at its working end, which terminates as a short first forked claw. A second forked claw of intermediate length is fixed at a second distance from the fulcrum and a long third fork claw is fixed at a second distance from the fulcrum with all forked claws being generally similarly curved and extending in the same direction from the bar. The second and third claws are used to fasten about a nail head which has been partially lifted above the surface on which the fulcrum is rested, for complete removal of the associated nail.

U.S. Pat. No. 4,826,136

Inventor: Philip G. Thomas

Issued: May 2, 1989

A lever type tool with an elongated handle, and a head having two opposed and spaced apart claws projecting in the same direction at the opposite sides of a space to closely receive a portion of a rectangular cross section of a lumber member.

U.S. Pat. No. 4,999,898

Inventor: Glenn E. Schmeling

Issued: Mar. 19, 1991

An improved tool for manually removing or installing rail anchors of the spring clip type, includes an anchor engaging portion adapted to grip the anchor during installation or removal from the rail base. A handle is provided which has an angular portion and a substantially horizontally extending portion attached to the anchor engaging portion and includes a contiguously formed downwardly extending step portion for permitting stepping forces to supplement forces generated by arm and hand motion.

U.S. Pat. No. 5,020,202

Inventor: James A. Turrell

Issued: Jun. 4, 1991

A tool for installing a spring clip for clipping together extensions for sheet metal. An angled handle terminates in an extended underlip at an operating end. A jaw having a flat bottom face and a hooked end is pivotally affixed, offset from the underlip. The underlip is curved to form a pushing face, opposed to the hook on the jaw. The tool is used to install a spring clip on sheet metal extensions, placing one end of the spring clip across a sheet metal extension and hooking the sheet metal extension and clip together with a jaw hook. By pivoting down the handle, the underlip presses against the opposing sheet metal extension forcing the extensions together and forcing the jaw face down over the spring clamp clipping the clamp over the sheet metal extensions, installing the clip.

U.S. Pat. No. 5,271,115

Inventor: Richard A. Senters

Issued: Dec. 21, 1993

A brake slack adjuster and tire tester tool including a main support assembly having mounted thereon a connector hook assembly and, on an outer end, an arm connector and tire tester assembly. The tool support assembly has a main handle assembly having on one end a hand gripper assembly which is operable to be grasped by the user thereof. The connector hook assembly is provided with a main hook member secured to an outer portion of the main handle member and operable to grasp onto a portion of a rocker arm assembly of an air brake assembly on a truck/trailer assembly. The arm connector and tire tester assembly is provided with a tire tester section and an arm connector section. The tire tester section is operable for impacting an outer surface of a tire member to check the condition thereof. The arm connector section is operable to contact and grasp a portion of the rocker arm assembly of the air brake assembly and cooperates with the connector hook assembly for ease of pivotal movement of the rocker arm assembly for testing slack in the air brake assembly.

U.S. Pat. No. 5,626,063

Inventor: Delbert D. Kosbab

Issued: May 6, 1997

A tool for shifting the locking bar of a fifth wheel of a tractor from a locked position to an unlocked position includes an elongate handle having a U-shaped locking handle engaging member. The handle includes a straight portion, an offset portion, and a terminal portion having the U-shaped member affixed to its outer end. The U-shaped member engages the locking handle in overlying relation and the terminal portion underlies and engages the offset portion of the locking handle whereby when the tool is rotated, the locking handle will be shifted to the unlocked position.

U.S. Pat. No. D424,901

Inventor: Allen Landry

Issued: Dec. 21, 1993

The ornamental design for a belt wench crank assembly, as shown and described.

U.S. Pat. No. 5,909,910

Inventor: Danny Craig Shaffer

Issued: Jun. 8, 1999

A tool comprising a bar with a pair of teeth proved at one end of the bar and a handle portion attached at the other end of the bar approximately perpendicular to the bar. The teeth are spaced apart from each other in order to allow an end of a t-post clip to removably insert therebetween. The teeth are approximately parallel with the handle and extend outward from the bar in a direction opposite the direction that the handle extends from the bar. The tool is used to twist the ends of t-post clips in order to secure the clips to fence wire to the t-post, or alternately, to remove clips therefrom.

U.S. Pat. No. 6,634,620

Inventor: Henry Sim

Issued: Oct. 21, 2003

The present invention 10 discloses a special purpose tool for removing control arms 18 from ball joint sockets 24 of vehicles 20. The present invention comprises an elongated handle 22 consisting of steel tubing along with a front end piece 16 made from steel round stock being offset with member 30 from the handle 22. Also a U-shaped bracket 28 is welded to the front end piece wherein the bracket has a hook 34 with a point 38 on the hook for contacting various structures of the vehicle 20. The point 38 of the hook, the front tip 36 and the handle 22 all lie in a single plane so that the tool will not rotate and slip off the work piece. The present invention can also have variously shaped surfaces on the point 38 of the hook and the front tip 36 for contacting various structures on a vehicle.

There are other devices used for specialized prying of automotive components, but while these prying devices may be suitable for the purposes for which they were designed, they would not be as suitable for the purposes of the present invention, as hereinafter described.

SUMMARY OF THE PRESENT INVENTION

A primary object of the present invention is to provide a prying device having a specially braced bracket having a transversal prying tip hooking component specially used for delivering leverage to a vehicles control arm.

Another object of the present invention is to provide a prying device specially suited for the primary operation of prying control arms off of vehicles.

Yet another object of the present invention is to provide a prying device having a transverse bracket having a prying tip used to grasp or turn leverage against vehicular components.

Still yet another object of the present invention is to provide a prying device that us easy to manufacture.

Yet another object of the present invention is to provide a prying device having a prying tip that may be utilized to grasp a work piece under force and manipulate said piece into a desired location and orientation.

Additional objects of the present invention will appear as the description proceeds.

The present invention overcomes the shortcomings of the prior art by providing a device primarily utilized in the prying of control arms on vehicles having a plurality of small and large braces utilized to support a transversely positioned bracket having a prying tip composed of typically rounded stock that is utilized to grab a vehicles control arm during a prying operation and effectively establish an increased bending or prying efficiency with the provided increase of grip and provided by said prying tip. Additionally the present invention has an elongated grip to develop a sufficient moment arm from a user to utilize efficiently along with said grip having a curved portion to gain proper angling and placement of the device's work end.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
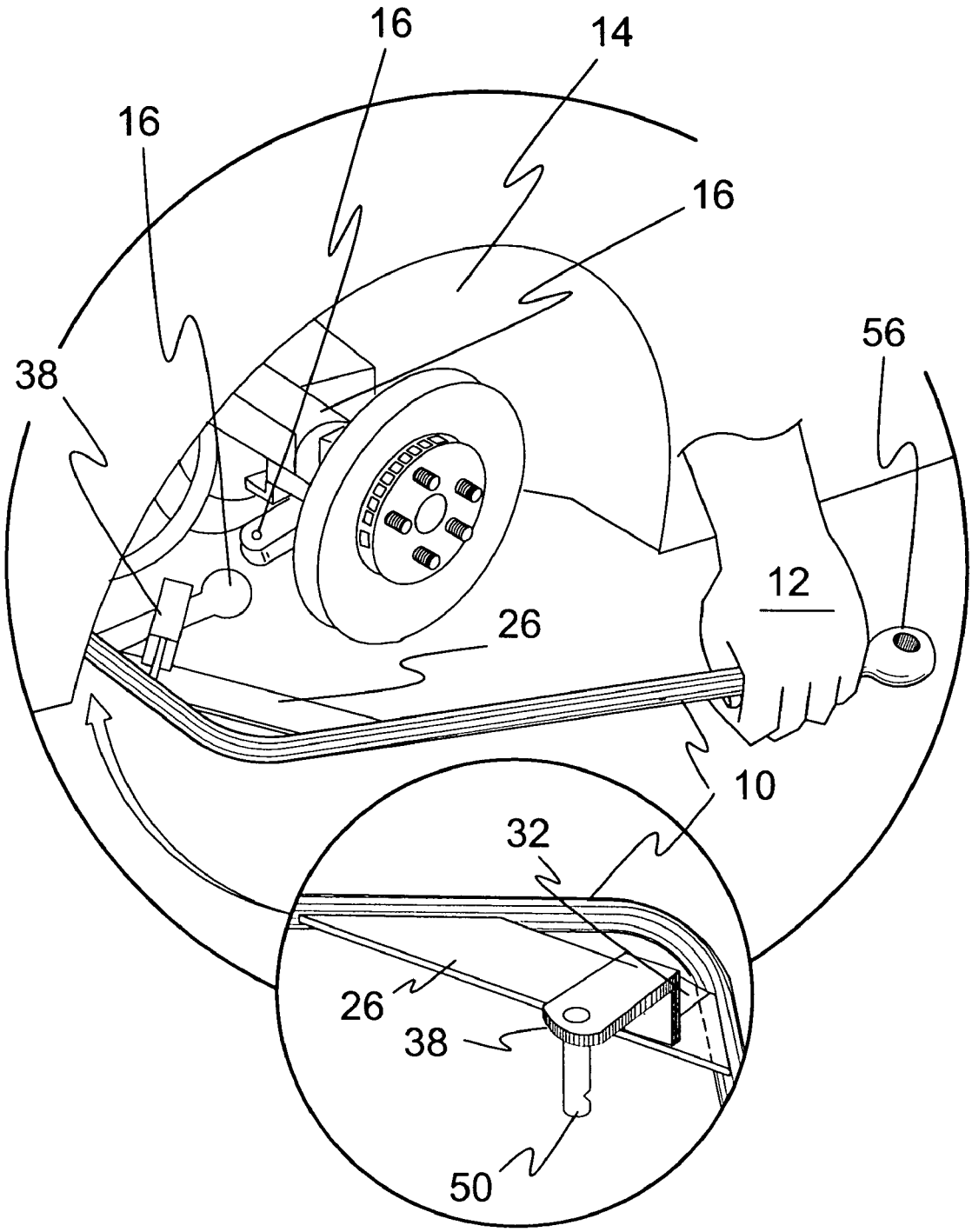
FIG. 1 is an illustrative view of the present invention.

Turning now descriptively to the drawings. In which similar reference characters denote similar elements, throughout the several views, the figures illustrate the Automotive Suspension Tool of the present invention. With regard to the reference numerals used, the following numbering is used throughout the various drawing figures.

10 Automotive Suspension Tool
12 user
14 motor vehicle
16 vehicle suspension
18 elongated handle housing section
20 housing bend
22 housing arm section
24 housing end tip
26 brace
28 brace joint
30 arm brace joint
32 bracket support
34 support and brace engaging surfaces
36 support and bracket engaging surfaces
38 bracket
40 bracket brace section
42 brace and bracket engaging surfaces
44 cantilevered bracket section
46 cantilevered depending member joint
48 cantilevered depending member
50 spar
52 spar inflection
54 spar receptacle

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown an illustrative view of the present invention in use. The automotive suspension tool 10 of the present invention provides the user 12 with leverage means for engaging, disengaging and aligning automotive suspension parts 16 of motor vehicle 14. The present invention provides a vehicle control arm tool 10 where the front end piece 50 and bracket 38 of tool 10 are engaged with the lower control arm 16 of a vehicle 14, downward pressure on the handle will pry the control arm 16 out of the ball joint socket 16 so the steering knuckle can be moved out of the way and the axle can then be removed from the transaxle.

Figure 2:
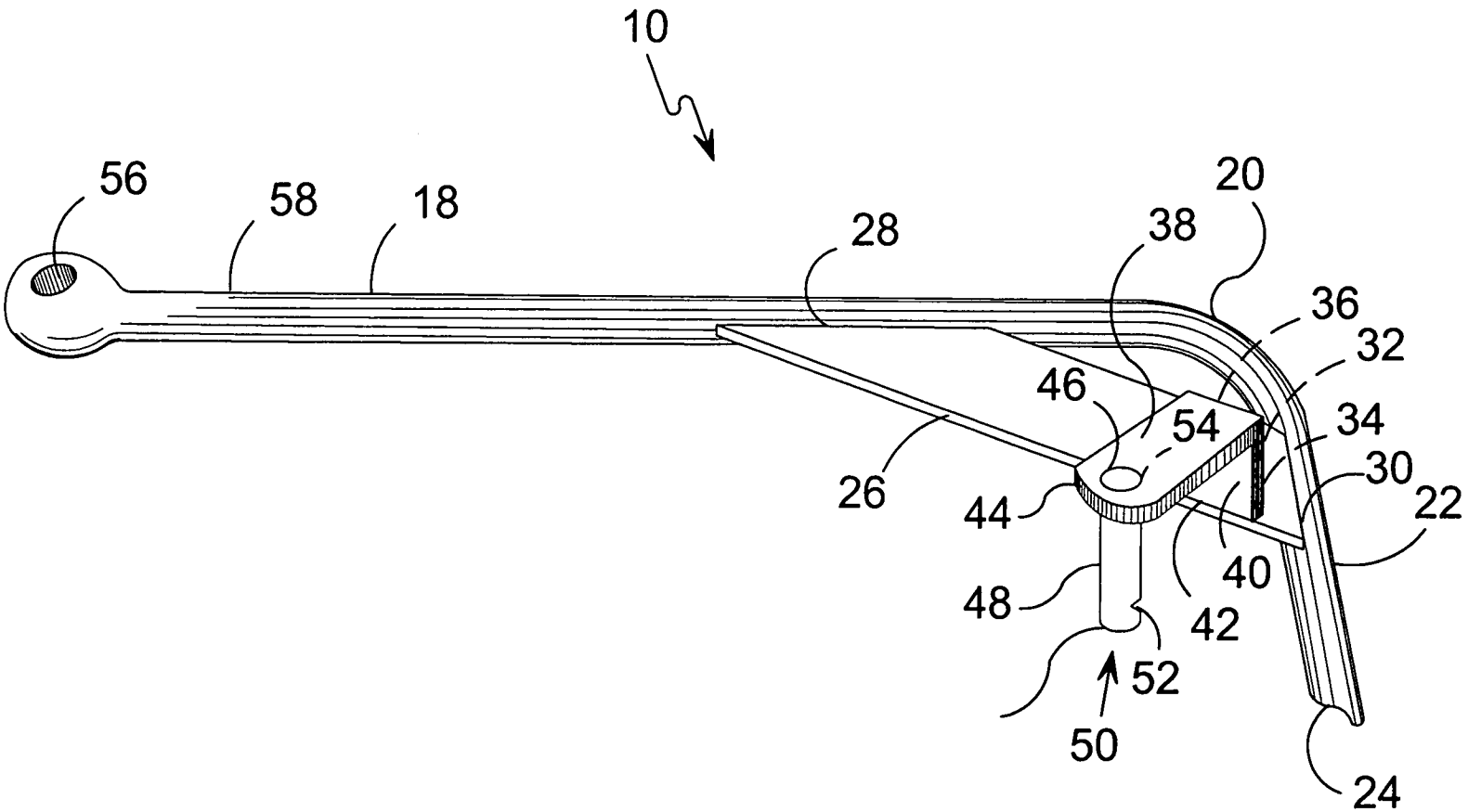
FIG. 2 is a perspective view of the present invention.

Referring to FIG. 2, shown is the automotive suspension tool having an elongated handle 18 extending through a bend 20 into arm member 22, which terminates at tip 24. Optionally, the elongated handle incorporates a section of knurling 58 and handle 18 throughbore 56. Brace 26 extends between handle 18 and arm 22 having an engaging surface 28 with the elongated handle 18 and arm section 22 at arm brace joint 30. Extending from the base transversally, bracket 38 has an engaging surface with brace 26 at joint 42 and is further reinforce by bracket support 32 with the support having support brace joint 34 and support bracket joint 36. Bracket 38 extends into cantilevered bracket section 44 that forms an anchor for depending member 48, preferably spar 50 with groove 52 opposingly facing bracket brace section 40. Spar 50, depending from bracket 44 at spur receptacle 54 forming cantilevered depending member joint 46.

Figure 3:
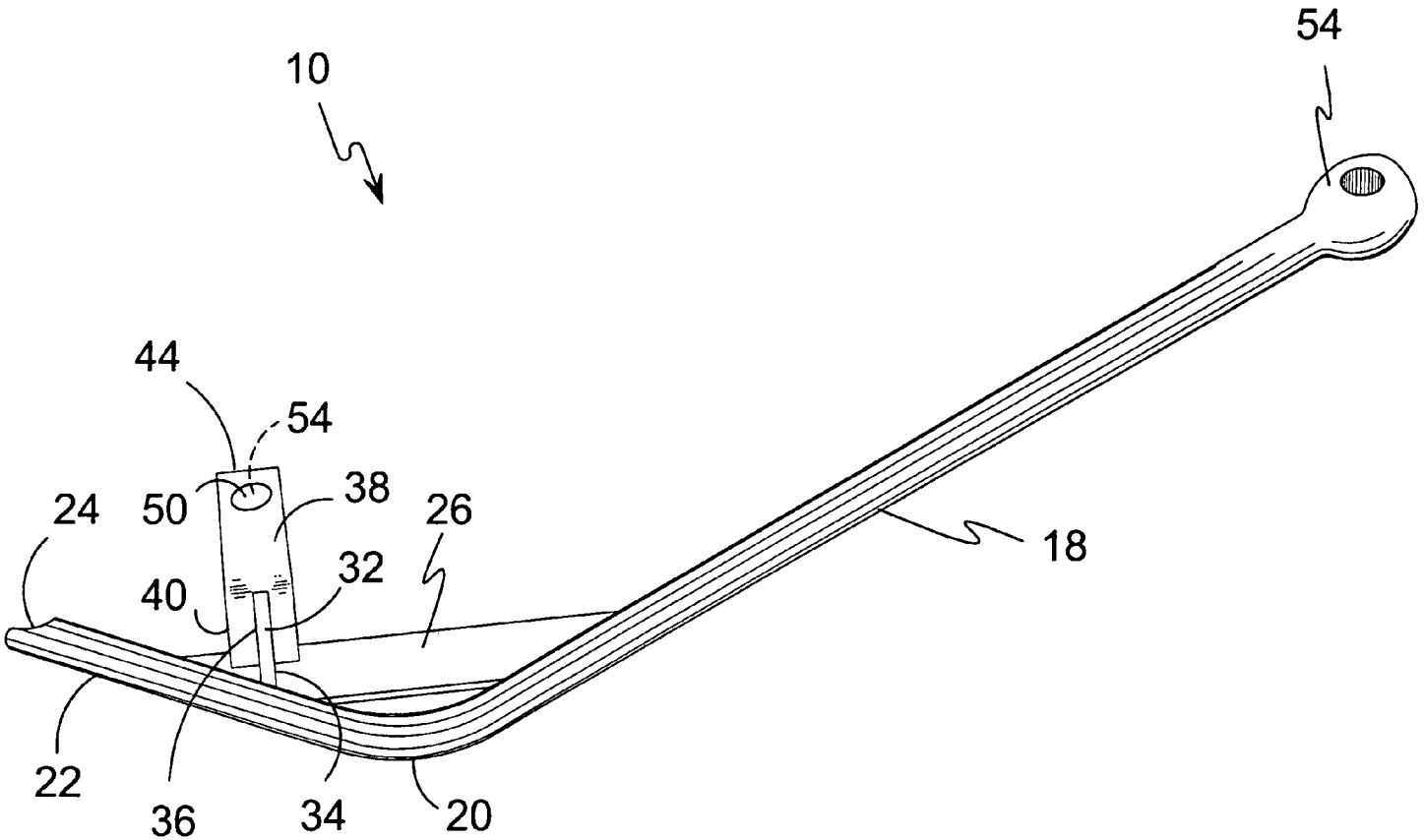
FIG. 3 is a perspective view of the present invention.

Referring to FIG. 3, shown is a back perspective view of the automotive suspension tool with elongated handle 18 extending through bend 20 into arm member 22 terminating at tip 24. Brace 26 extends between handle 18 and arm 22. Extending from the base transversally, bracket 38 has an engaging surface with brace 26 and is further reinforce by bracket support 32 with the support having support brace joint 34 and support bracket joint 36. Bracket 38 extends into cantilevered bracket section 44 that forms an anchor for spar 50 depending from bracket 44 at spur receptacle 54.

Figure 4:
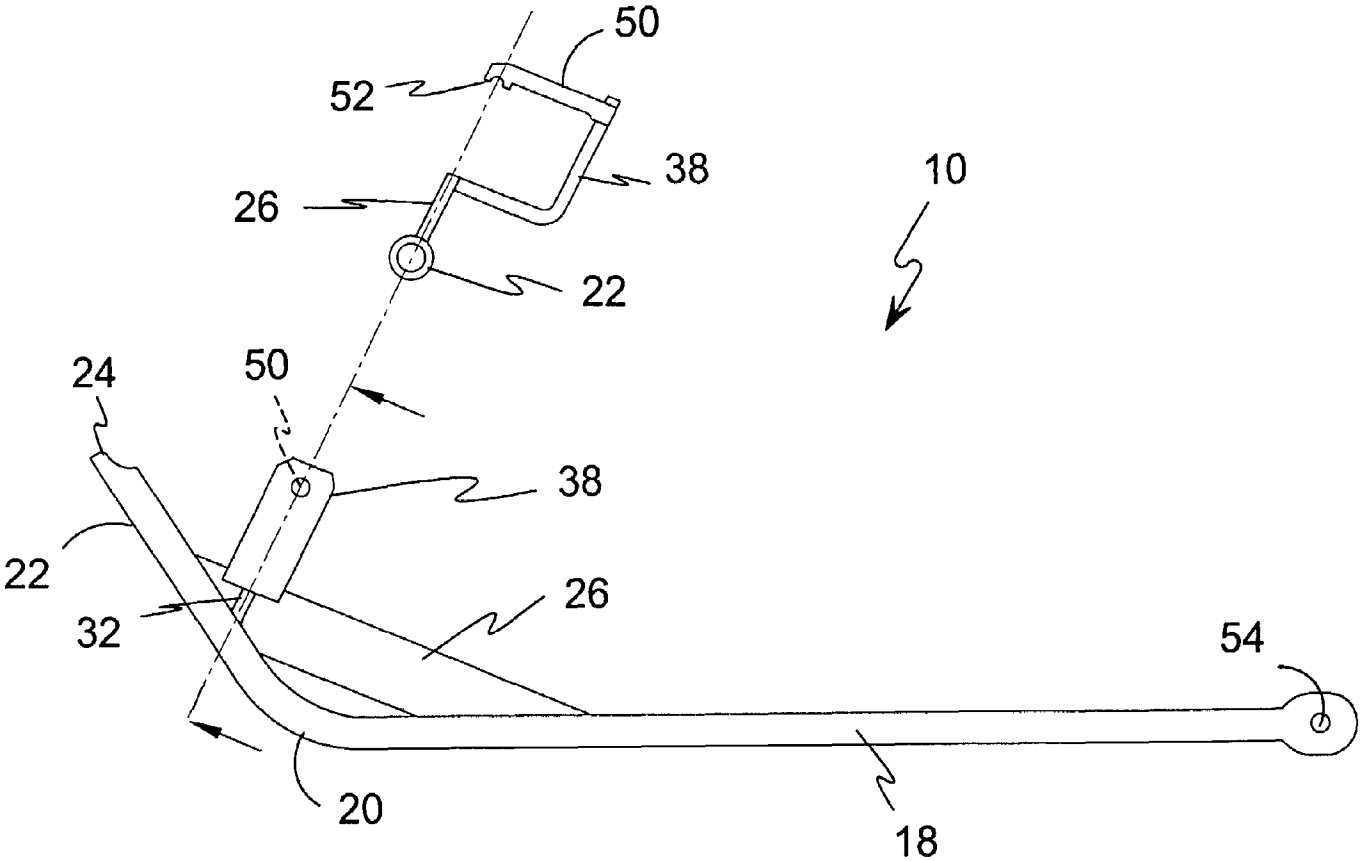
FIG. 4 is an orthographic view of the present invention.

Referring to FIG. 4, shown is a top and sectional view of the automotive suspension tool with elongated handle 18 extending through bend 20 into arm member 22 terminating at tip 24 with the font tip having variable shapes when applicable and optionally having frictionally material fixed thereto. Brace 26 extends between handle 18 and arm 22. Extending from the base transversally, bracket 38 has an engaging surface with brace 26 and is further reinforce by bracket support 32 with the support having support brace joint 34 and support bracket joint 36. Bracket 38 extends into cantilevered bracket section 44 that forms an anchor for spar 50 depending from bracket 44 at spur receptacle 54. Spar 50 having inflection 52 will also vary in contour as the tool will find additional uses and for specific tasks.

Figure 5:
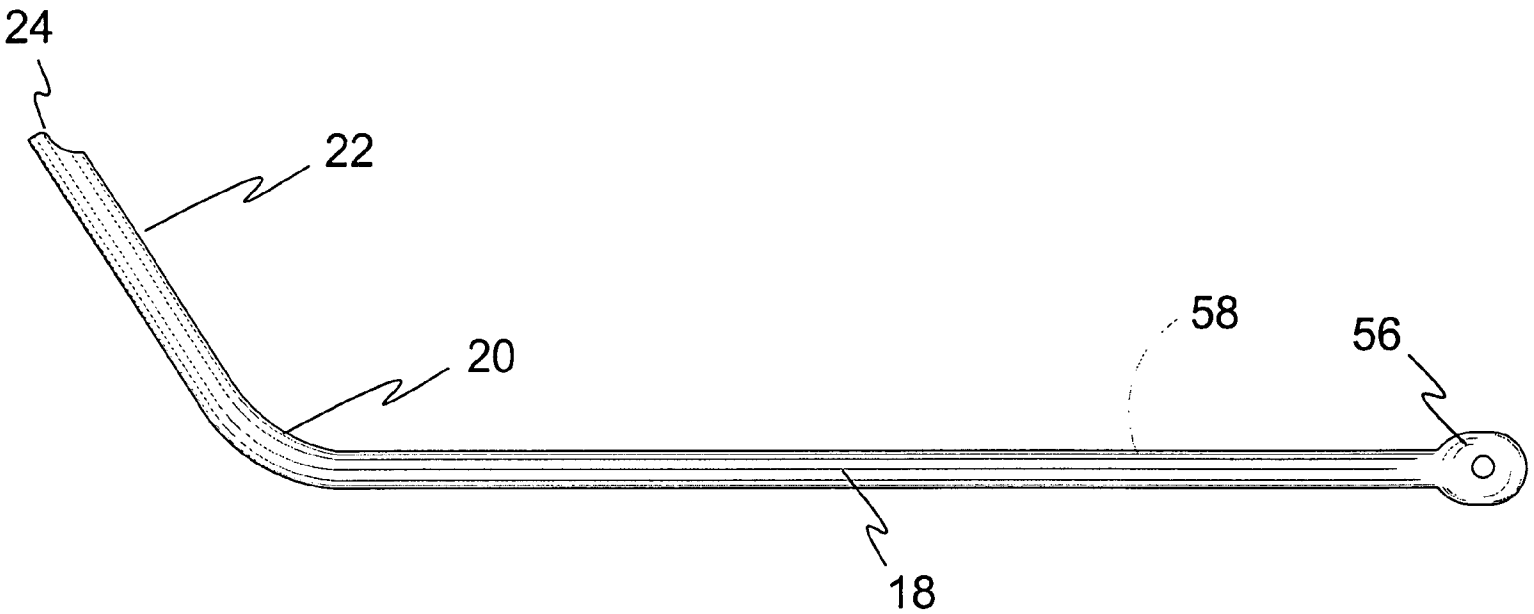
FIG. 5 is a side view of the handle of the present invention.

Referring to FIG. 5, shown is a side view of the handle of the present invention. Preferably, the housing of the automotive suspension tool has an elongated handle 18 extending through bend 20 into arm member 22 terminating at tip 24. Optionally, the elongated handle incorporates a section of knurling 58 and handle 18 throughbore 56. As illustrated in cross section, the housing consists of approximate 1 inch steel tubing which minimizes the weight but has alternately considered a solid shaft member, in whole or in part, that may have application in other areas and therefore is included by reference.

Figure 6:
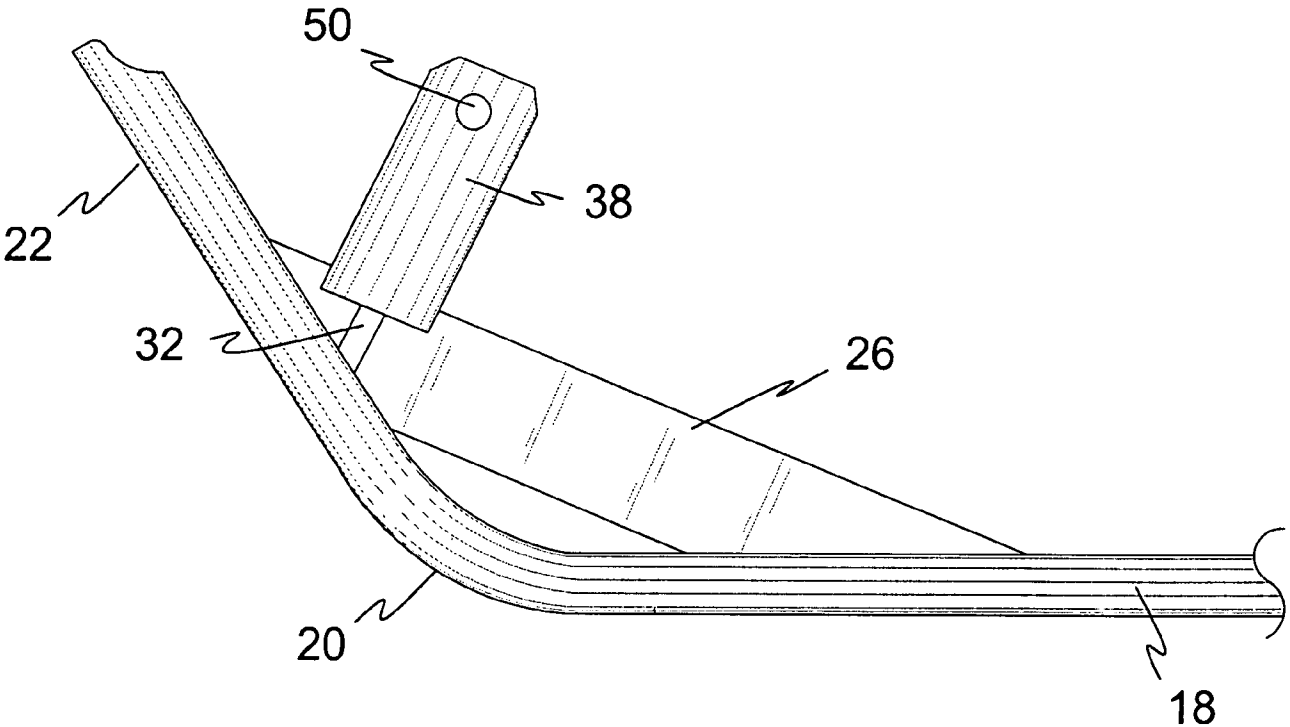
FIG. 6 is a partial detail view of the present invention.

Referring to FIG. 6, shown is a partial view of the automotive suspension tool with elongated handle 18 extending through bend 20 into arm member 22 terminating at tip 24. Brace 26 extends between handle 18 and arm 22. Extending from the base transversally, bracket 38 has an engaging surface with brace 26 and is further reinforce by bracket support 32 with the support having a support brace joint and support bracket joint. Bracket 38 extends into cantilevered bracket section that forms an anchor for spar 50 depending from bracket 38.

Figure 7:
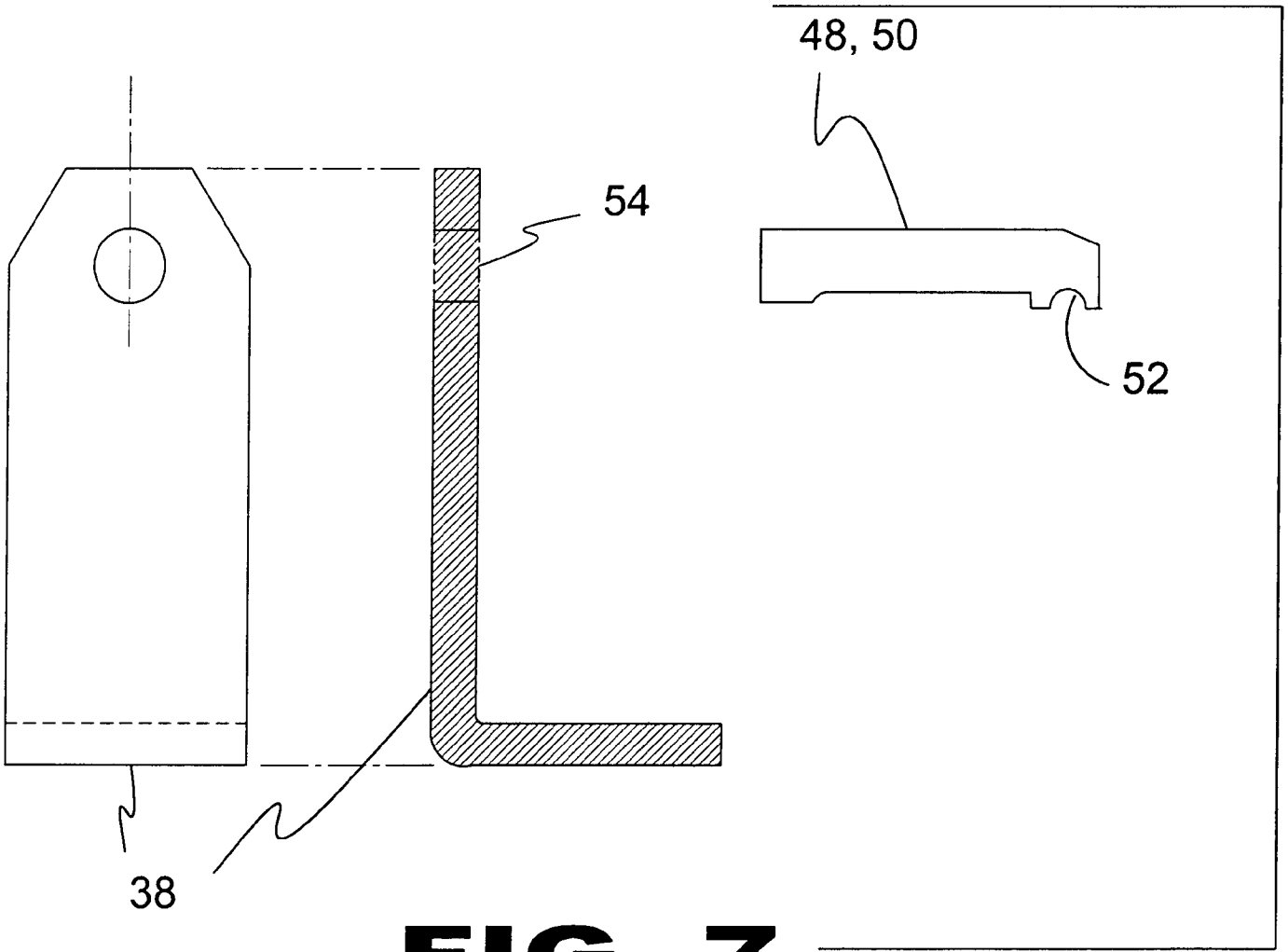
FIG. 7 is a top view of the bracket and hook of the present invention.

Referring to FIG. 7, shown is the bracket and spar of the automotive suspension tool. Bracket 38 extends into a cantilevered bracket section that forms an anchor for depending member 48, preferably spar 50 with groove 52 opposingly faces the bracket brace section. Spar 50, depending from bracket 38 at spur receptacle 54 forms means whereby the tool can be hooked onto the lower control arm of various vehicles.

Figure 8:
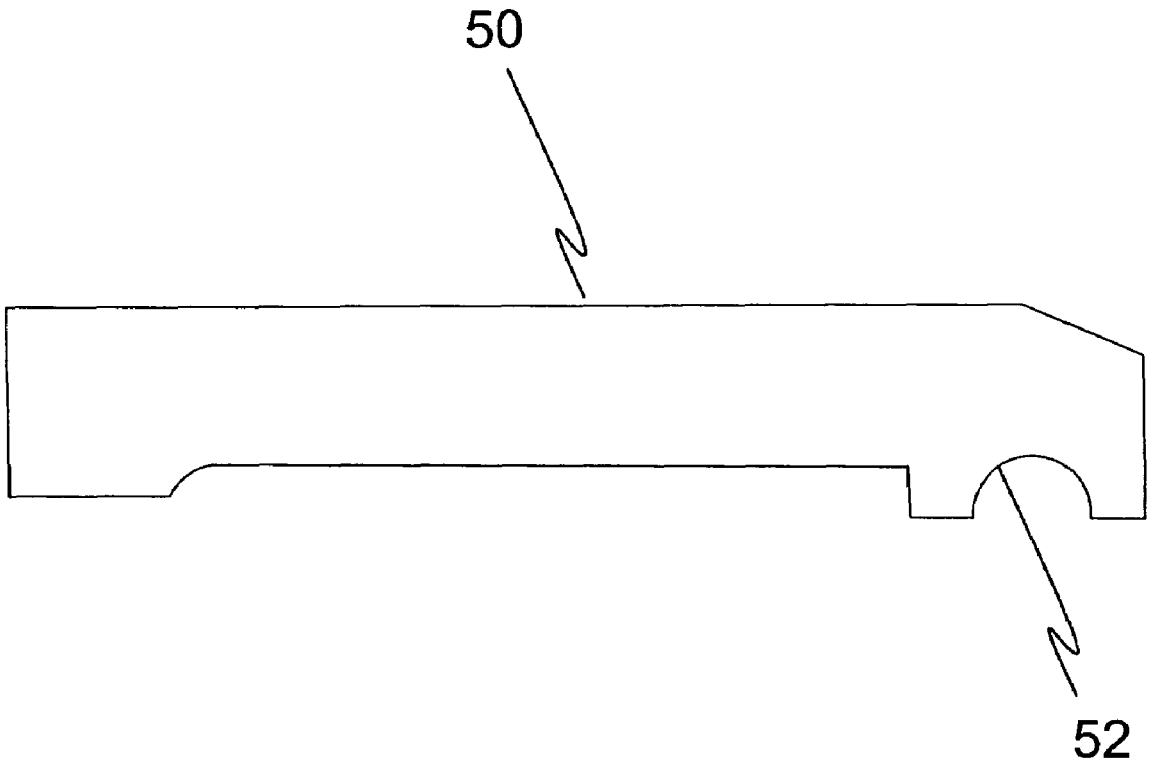
FIG. 8 is a detail view of the hook portion of the present invention.

FIG. 8 is a detail view of the hook-like spar portion of the present invention. Shown is the contact point of the spar 52, the front tip 24 and the handle 18, 20, 22 are designed so the tool will not rotate and slip off the work piece 16. The hook 52 forms one leg of the overall bracket and has a point or protrusion disposed perpendicularly and inwardly thereon for gripping a surface.

Figure 9:
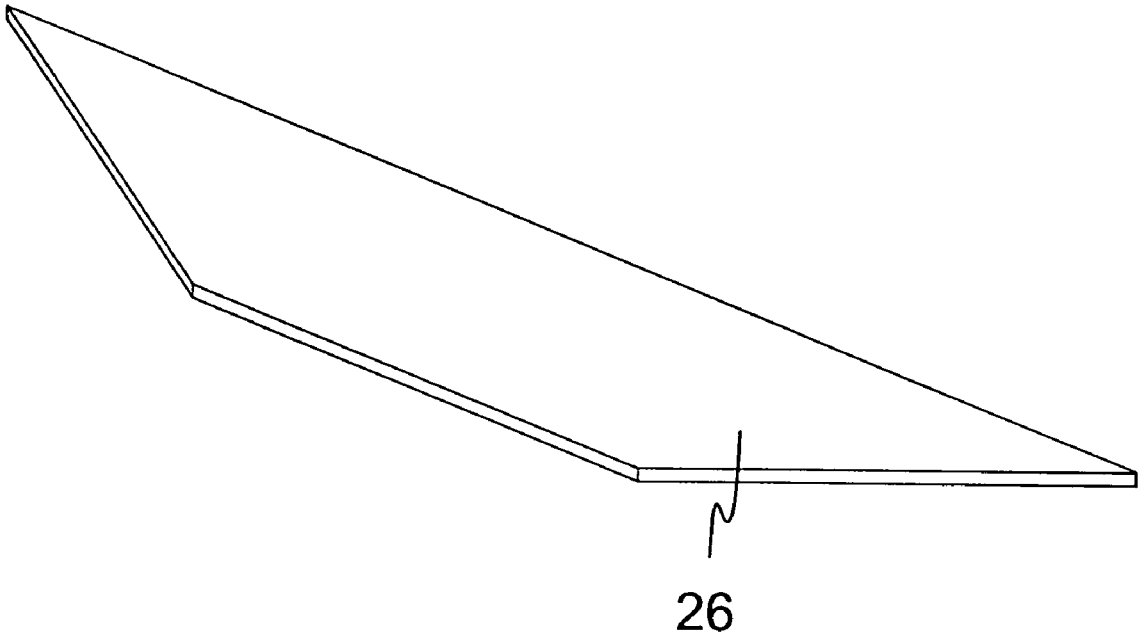
FIG. 9 is a detail view of the main brace of the present invention.

FIG. 9 is a detail view of the main brace of the present invention. Shown is the main brace 26 of the present invention preferably, being flat stock mild steel and 17 inches in length, sheared at 40 degrees and 25 degrees.

Figure 10:
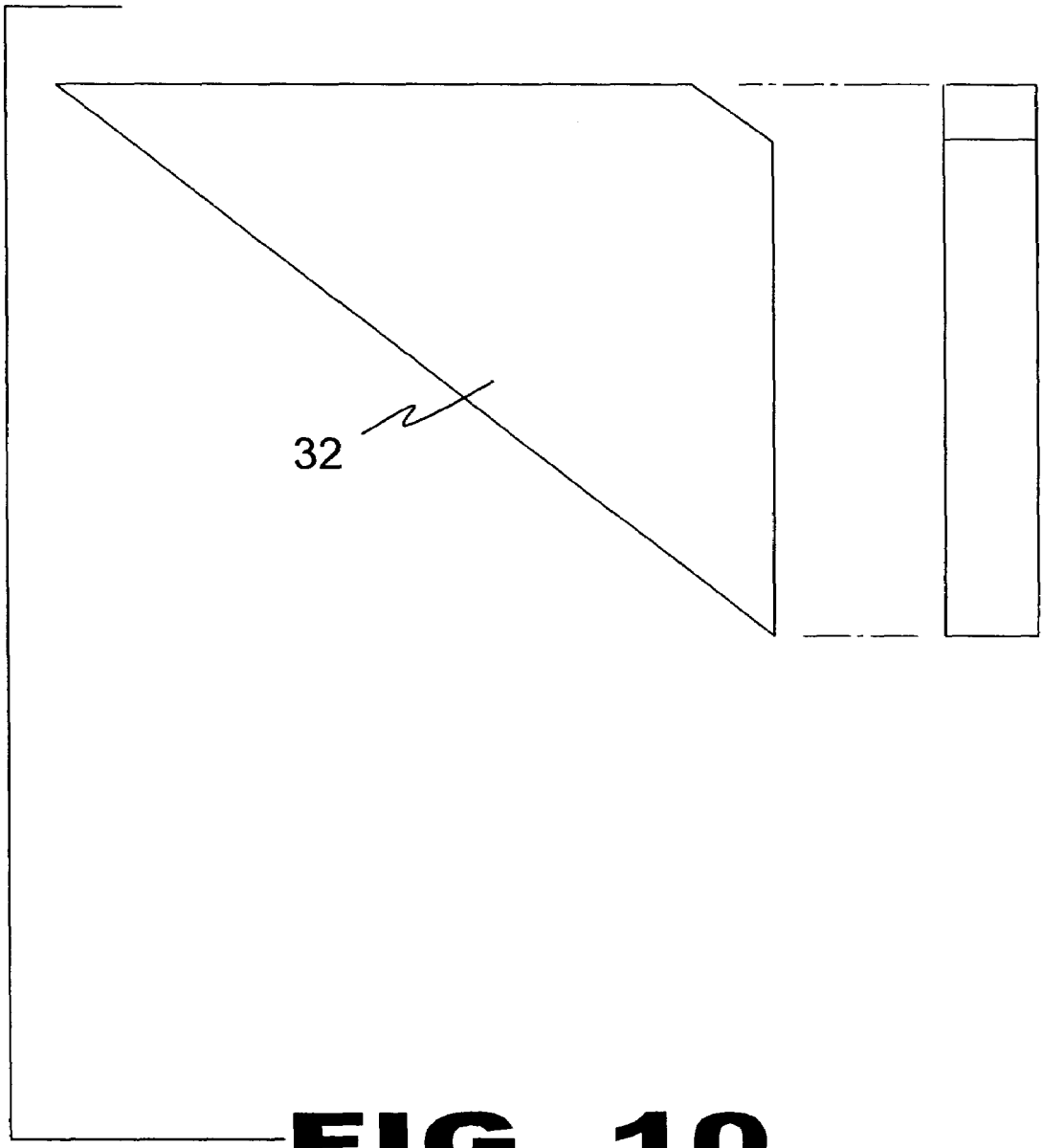
FIG. 10 is a detail view of the small brace of the present invention.

FIG. 10 is a detail view of the small brace of the present invention. Shown is the small brace 32 for the bracket 38 of the present invention preferably being ¼" mild steel plate.

Figure 11:
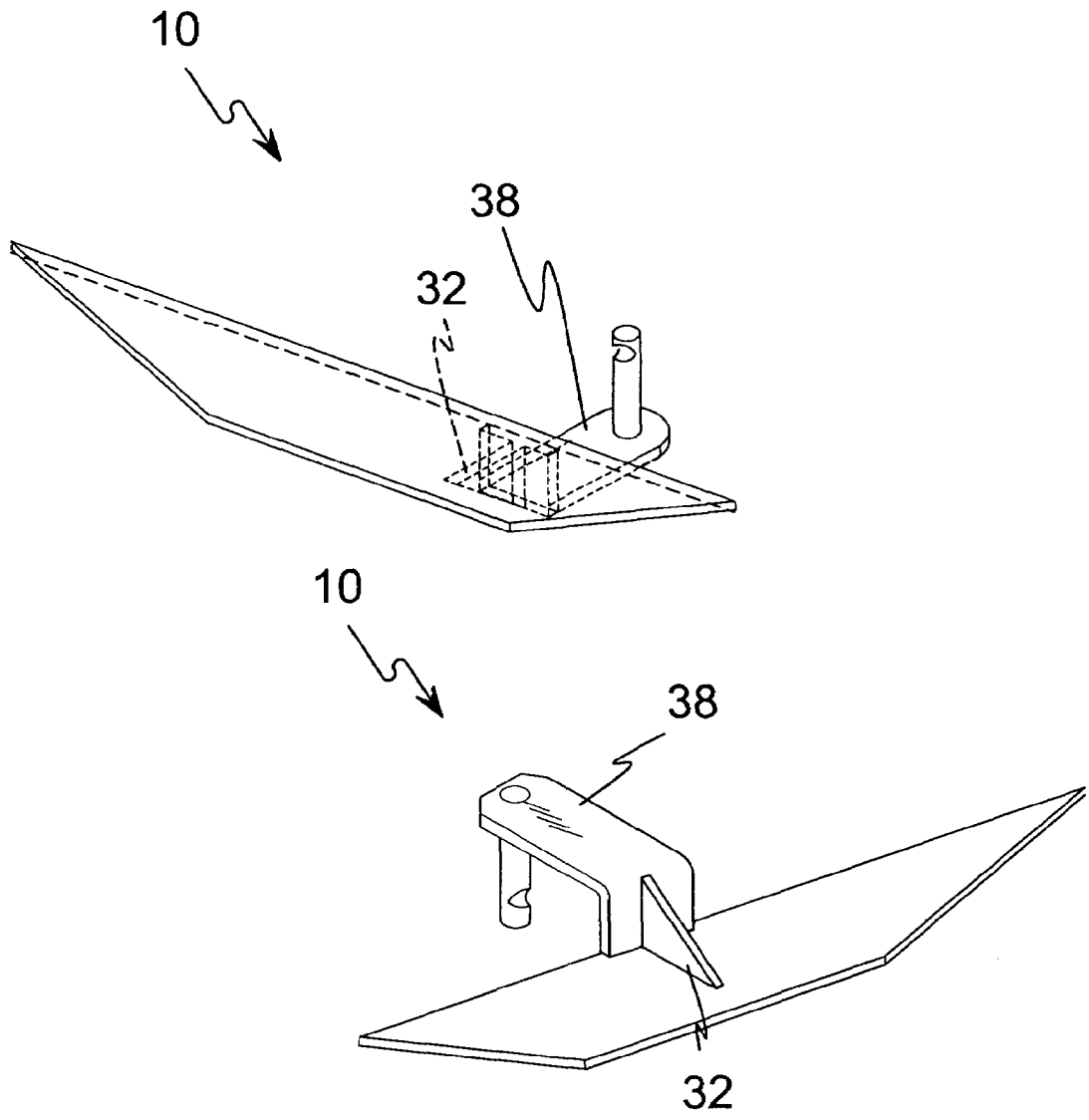
FIG. 11 is two detailed perspective views of the present invention.

FIG. 11 is two detailed perspective views of the present invention. A bracket 38 is transversally attached by welding to the front offset piece of 26 by a small brace and a main brace in order to allow the tool to be hooked onto the lower control arm of various vehicles. Also shown is the front tip 24 of the front end piece 22. The contact point of the hook 50, the front tip and the handle are designed so the tool will not rotate and slip off the work piece. The hook forms one leg of the bracket and has a point or protrusion disposed perpendicularly and inwardly thereon for gripping a surface.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

It will be understood that each of the elements described above, or two or more together may also find a useful application in other types of devices differing from the type described above.

What is claimed is new and desired to be protected by Letters Patent is set forth in the appended claims:

1. An apparatus for a pry bar for engaging structural members of a vehicle, comprising:

a) an elongated member forming a handle having a bend at one end extending into an arm member;

b) said arm member having a tip with a contour face;

c) a flat brace fixed between the elongated member and arm member, said brace having upper and lower surfaces, ends of said brace being coextensive with and attached to said arm member and handle, respectively, and a distal side edge facing away from said bend and an opposite facing side edge spaced from said bend;

d) an L-shaped bracket fixedly cantilevered from said brace, said bracket comprising a pair of legs at right angles to each other, with a bottom edge of a first leg thereof mounted on said upper surface of, and adjacent the distal side edge of said brace, and a second leg of said bracket extending away from said brace and said bend and forming a cantilevered section;

e) a cylindrical shaped spar depending from and fixed adjacent a distal end of said second leg of said bracket and terminating substantially in line with and spaced from the distal side edge of said brace; and f) a groove formed in said spar adjacent a free end of said spar facing said brace forming a prying tip.

2. The apparatus of claim 1, further comprising a bracket support fixed between the bracket and brace.

3. The apparatus of claim 2, wherein said brace has an engaging surface with said bend.

4. The apparatus of claim 2, wherein said bracket support is a wedge having an engaging side with the bracket and an engaging side with the brace.

5. The apparatus of claim 2, wherein said bracket support is a bar conjoining with the bracket at one end and the brace at the other.

6. The apparatus of claim 2, wherein said elongated member has a free end with a bulbous shape with a throughbore extending therethrough.

7. The apparatus of claim 6, wherein said groove in said spar has a convex surface.

8. The apparatus of claim 6, wherein said groove in said spar is a notch.

9. The apparatus of claim 1, wherein said elongated member incorporates means for engaging a fastener.

10. The apparatus of claim 9, wherein said means for engaging a fastener is an aperture.

11. The apparatus of claim 10, wherein said aperture is a throughbore.

12. The apparatus of claim 1, wherein said end contour face is concave.

13. The apparatus of claim 1, wherein said end contour face is textured.

14. The apparatus of claim 1, wherein said bracket spar has a contoured section.

15. The apparatus of claim 14, wherein said contoured section is concave.

16. The apparatus of claim 1, wherein said bracket is sheet material.

17. The apparatus of claim 16, wherein said bracket cantilevered section has an aperture for anchoring said spar therefrom.

18. The apparatus of claim 1, wherein said brace is of sheet material.

19. The apparatus of claim 18, wherein said brace has an engaging side with said elongated member and another engaging side with said arm member.

20. The apparatus of claim 1, wherein said elongated member and said arm member in cross section are tubular.

21. The apparatus of claim 1, wherein said elongated member and said arm member in cross section are solid.

22. The apparatus of claim 1, wherein said elongated member and said arm member are metal.

23. The apparatus of claim 1, wherein said elongated member and said arm member are of a composite material.

* * * * *